United States Patent [19]

Owens

[11] 4,054,867

[45] Oct. 18, 1977

[54] DETECTING DAMAGE TO BULK MATERIAL

[75] Inventor: John Murry Owens, Edinburgh, Scotland

[73] Assignee: Microwave and Electronic Systems Limited, Newbridge, Scotland

[21] Appl. No.: 677,645

[22] Filed: Apr. 16, 1976

Related U.S. Application Data

[63] Continuation of Ser. No. 358,578, May 9, 1973, abandoned, and a continuation-in-part of Ser. No. 247,180, April 24, 1972, abandoned.

[30] Foreign Application Priority Data

| | | |
|---|---|---|
| Dec. 10, 1971 | United Kingdom | 57598/71 |
| Dec. 5, 1972 | South Africa | 72/8609 |

[51] Int. Cl.[2] ..... G08B 13/04; G08B 29/00

[52] U.S. Cl. ..... 340/274 R; 340/261; 340/409

[58] Field of Search ..... 340/261, 409, 274

[56] References Cited

U.S. PATENT DOCUMENTS

| | | | |
|---|---|---|---|
| 2,524,579 | 10/1950 | Taylor | 340/261 |
| 3,147,467 | 9/1964 | Laakmann | 340/261 |
| 3,579,220 | 5/1971 | Stevenson, Jr. | 340/261 |

*Primary Examiner*—Glen R. Swann, III

*Attorney, Agent, or Firm*—Sughrue, Rothwell, Mion, Zinn and Macpeak

[57] ABSTRACT

Damage to sheet glass is detected by monitoring with a piezo-electric sensor vibrations at ultrasonic frequencies propagated in the glass. Cutting, scoring or chipping of glass generates a frequency spectrum having high frequency components at greater than 100 kilohertz and particularly at about 300 kilohertz. By selective detection at these frequencies cutting, scoring and chipping are distinguished from lower frequency vibrations due to wind and traffic rumble. Cutting and scoring are distinguishable from chipping because the high frequency components occur in numerous bursts in the former against but few bursts in the latter. Shattering of the sheet glass is detected by the high energy of much larger amplitude high frequency components produced thereby. Apparatus to carry out these functions is described and finds particular use in an intruder alarm system.

6 Claims, 3 Drawing Figures

DETECTING DAMAGE TO BULK MATERIAL

REFERENCE TO RELATED APPLICATIONS

This is a continuation of application Ser. No. 358,578 filed May 9, 1973, now abandoned, and a continuation-in-part of application Ser. No. 247,180 filed Apr. 24, 1972, now abandoned.

FIELD OF THE INVENTION

This invention relates to the detection of physical damage caused to a bulk material capable of propagating wave energy at ultrasonic frequencies. The invention finds particular utility in detecting damage caused to sheet material such as glass and a specific application of the invention is in security systems where it is desired to detect attempted entry through glass windows or doors or where a glass pane is cut in order to obtain access to what lies behind it.

BACKGROUND OF THE INVENTION

In a security system there are two goals to be aimed at: one is the certainty of detection of a threat to the security of whatever is protected by the system; the other is freedom from false alarms. Unfortunately these two aims tend to be mutually contradictory and any practical system is a compromise between them. It is an object of this invention to provide a security system for detecting attempts to make an entry through sheet glass which aims to give a high degree of protection against deliberate threats to security while maintaining a relative freedom from false alarms due to various causes which are explained more fully below.

Thus the invention is particularly concerned with the protection of premises in which there are windows, glass doors or the like through which entry may be forced into the premises. Entry through a window which entails breaking the glass can be readily detected since the breakage will set up vibrations in the glass and these vibrations can be detected. Mechanically operating vibration detectors have been proposed in the past. Alternatively the vibrations can be detected by a transducer and converted to an electrical signal monitored at some remote point. However, a monitoring arrangement which responded to all vibrations of the glass would render the system highly liable to false indications of entry. For example, it is found that vibration of the glass due to wind, traffic vibration or tapping of the glass would produce an alarm indication as well as an attempt to actually break the glass, or as is more likely, to cut the glass in order to remove a portion of it to gain entry.

SUMMARY OF THE INVENTION

Investigation has shown that where a sheet of glass is actually cut or scored, or is chipped or broken not only are low frequency vibrations set up, say in the order of 30 kHz, but there is a small content of high frequency vibration propagated through the glass at frequencies in excess of 100 kHz and extending at least up to 400 kHz in the kinds of glass so far investigated (including laminated glass and armoured glass). Detection of high frequency vibrations to the exclusion of the lower frequencies previously mentioned provides the basis on which the apparatus particularly described below for detecting damage to glass operates though, as will become apparent later, other features are added which provide further discrimination against false alarms being given.

It is contemplated that the above principles may be applied to the detection of damage to other like material and broadly the present invention provides apparatus for detecting damage to sheet glass or like material capable of propagating wave energy at ultrasonic frequencies, comprising a transducer device attachable to sheet glass or like material to provide electrical signals corresponding to vibrations propagated therein; a filter responsive to said electrical signals provided by said transducer device to stop signal components representing vibrations sensed by said transducer device having a frequency less than 100 kHz; and means responsive to the filtered signals to provide an output signal.

In the above-defined apparatus the filter may be coupled to the transducer device directly by cable or over a radio link, the filter being conveniently preceded by an amplifier if necessary. Such an amplifier may have an plurality of transducer devices coupled to its input. The filter may act at the ultrasonic vibration frequencies or at another part of the frequency spectrum to which the ultrasonic frequencies are translated. In the application of the invention to detecting the breaking or cutting of sheet glass, the form of vibration characteristic of the cutting or scoring of glass with a glass cutter is distinguished from other forms of vibration set up in the glass as by tapping or general vibration of the glass as a whole, by detecting vibration frequencies exclusively in excess of 100 kHz, i.e. the filter acts to stop signals representing vibrations or vibration components in the glass at frequencies less than 100 kHz. It is preferred to monitor frequencies in excess of 250 kHz.

BRIEF DESCRIPTION OF THE DRAWINGS

In order that the invention and its preferred features may be better understood embodiments of it applied to a security system will now be described with reference to the accompanying drawings in which.

DESCRIPTION OF THE PREFERRED EMBODIMENTS

Figure 1:
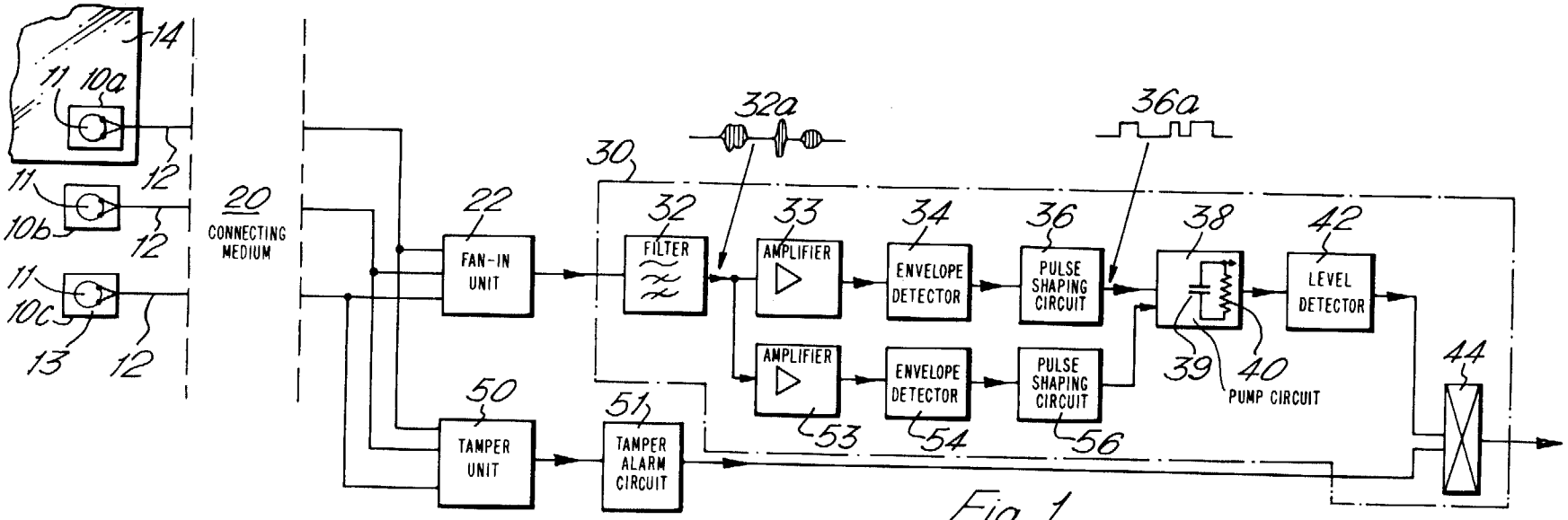
FIG. 1 shows the system in block diagram form.

Referring to FIG. 1, three vibration sensors 10*a*, *b* and *c* are shown. The sensors each comprise a transducer disc 11 of piezo-electric material capable of converting pressure wave energy or vibrations of a medium to which the transducer disc is coupled into corresponding electrical vibrations applied to a transmission cable 12. This disc can be of the ceramic piezo-electric material known under the name PZT. Each disc 11 is preferably potted in epoxy resin 13 for protection. Each sensor 10*a*, *b* and *c* is attached directly to a window, pane or other sheet of glass 14 (shown only for sensor 10*a*) in the premises to be protected. The attachment may be by an adhesive or by simply taping the sensor onto the glass. The sensors themselves are very small, say of the order of 10 mm. across, and thus may be located in an unobtrusive manner. Each device is connected to a signal-processing unit 30 through a connecting medium 20. The medium 20 may simply comprise connecting cables or could, for example, include a radio link. Since it is the high frequency content from the transducer devices which is of interest the cables should preferably be of a low capacitance twin or coaxial cable and be shielded to protect them from stray pick-up.

Figure 2:
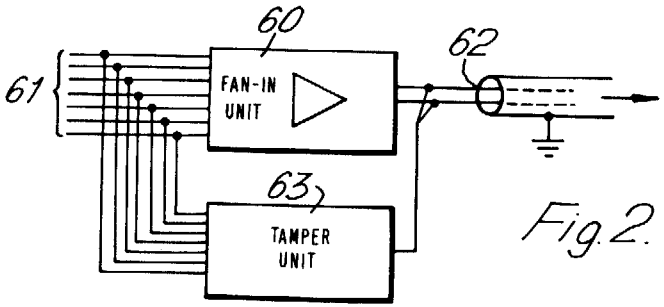
FIG. 2 shows a modification of a part of the system also provided with tamper detection.

By way of example, the illustrated apparatus has three sensors each connected through a respective cable 12 and through a combining or fan-in unit 22 to a signal processsing unit 30. Effectively the sensors are connected in parallel as far as unit 30 is concerned. Where the connecting cables are long enough to cause unduly high signal loss in transmission, the sensors can be connected to a relatively local fan-in unit which contains an amplifier and which is connected to the signal processing unit 30 through a cable. Such a connection is shown in FIG. 2 described more fully below. The sensors in each of a number of local areas may be connected to a common fan-in amplifier serving that area and the cables from the fan-in amplifiers be connected to the inputs of a fan-in unit adjacent the processing unit 30. In this way the system can be extended for a large number of sensors spread over a large area.

At input of the signal processing unit 30 there is a high-pass filter 32 which has a cut-off frequency of 100 kHz or greater, i.e. provides a stop band to frequencies below 100 kHz. It may be preferable to employ a filter having a cut-off frequency of say 250 kHz and a band-pass filter centered on 300 kHz has been successfully used. However, 100 kHz provides a reasonable demarcation between the high frequencies characteristic of the cutting, breaking or chipping of glass and the unwanted lower frequency vibrations due to other effects.

At this stage it should be further explained that not only has it been found that cutting of glass is characterised by a high frequency content in the vibrations propagated in the glass but that the vibrations tend to occur in bursts or pulses, the bursts being at a rate of the order of 1 kHz and containing a high frequency content above 100 kHz. It is preferred to not set off an alarm as the result of chipping and this additional characteristic enables this to be done.

The output from the high-pass filter 32 comprises these high frequency bursts of signal **32*a* in response to an attempt to cut the glass. The signal from the high-pass filter is applied through an amplifier 33 to an envelope detector 34 and the detected pulses are fed to a pulse shaping circuit 36 in the form of a Schmitt trigger. The Schmitt trigger 36 performs two functions. Firstly it discriminates against low level noise in the system since a predetermined signal amplitude is required to trigger the circuit. Secondly in response to each detected pulse of sufficient amplitude to exceed the threshold level needed to trip the Schmitt trigger there is produced a pulse of predetermined output amplitude as shown at 36*a***.

The output pulses from the Schmitt trigger 36 are taken to a pump circuit 38, including a storage capacitor 39 upon which the pumped-up or integrated signal is developed. Preferably the circuit 38 is of the diode or diode-transistor pump type in which a predetermined increment of charge is supplied to the capacitor 39 for each pulse from the Scmitt trigger. The voltage across the capacitor is monitored by a level detector 42 which upon sensing a pre-selected level of voltage developed across capacitor 39 energises a relay 44 from which an alarm signal is obtained.

In operation of the described circuit, in order to achieve a sufficient voltage across capacitor 39 to operate the level detector 42 a number of high frequency bursts of signal must have been received through a high-pass filter 32 in order to produce corresponding pulses from the Schmitt trigger 36. In practice unit 30 is adjusted such that something like 20 pulses from the Schmitt trigger are required to achieve the desired voltage level, assuming that these pulses occur at a mean rate of about 1 kHz as previously mentioned and that the capacitor has the discharge time constant discussed below. Thus the time for the circuit to respond is about 20 milliseconds.

An important feature of the circuit is the provision of the resistor 40 across the capacitor 39 giving a discharge time constant for the capacitor so that the combination acts as an averaging circuit. If there were virtually no leakage from the capacitor successive pulses at widely spaced intervals of time would eventually build up sufficient voltage on the capacitor to cause relay 44 to be operated. For example, many of the forms of vibration which have a predominately low frequency content also have some high frequencies included and continuous vibration of the glass or even continuous tapping of something on the glass would set off an alarm signal. This high frequency content is particularly obtained where tapping of the glass causes it to be chipped. However, chipping is accompanied by only a few bursts of high frequency signal. The resistor 40 has a value chosen to give a discharge time constant for the capacitor of about 100 milliseconds. Any tapping or periodic vibration of the glass would tend to produce a pulse rate very much lower than the 1 kHz at which the high frequency bursts occur during cutting of the glass and the resistor 40 would enable the charge built up by each tap to substantially leak away before the next increment of charge from the succeeding tap so that no appreciable voltage level could be built up across the capacitor 39. Also chipping of the glass as the result of a tap does not produce sufficient high frequency bursts to set off an alarm.

Although in the above described system it is not required to detect chipping, in a security application it would be necessary to detect sudden shattering of the glass. Investigation has shown that shattering is likely to be accompanied by one burst or at most, only a few bursts of high frequency signal though of large amplitude. The signal processor 30 as so far described is not responsive to different levels of bursts provided they are of sufficient level to trip the Schmitt trigger 36. Thus a few bursts due to a shattered sheet of glass do not necessarily charge up capacitor 39 sufficiently to given an alarm.

In cutting or scoring glass, the high frequency content is of low amplitude. When the glass is shattered the high frequency content may reach an amplitude some hundred times greater. Thus shattering is detectable by monitoring the level of the high frequency signal. To this end the output of filter 32 is also applied to an amplifier 53 which is of low gain compared with that of amplifier 33. The output of amplifier 53 feeds an adjustable level detector circuit which can be any form of level-sensitive switch circuit such as a detector 54 followed by a Schmitt trigger 56 set to trip at only the comparatively large signal levels indicative of shattering of the glass and which are substantially in excess of the levels required to trip the Schmitt trigger 36 by the corresponding envelope detected signals. In the illustrated embodiment, the Schmitt trigger 56 is arranged to discharge a sufficient quantity of charge directly into capacitor 39 of pump circuit 38 that level detector 42 immediately operates alarm relay 44. Of course, the second channel comprising units 53, 54 and 56 could be connected to operate relay 44 directly.

It is believed that the described circuit will provide a substantial discrimination against false alarms and since the circuit is based on an analysis of the signals produced by cutting and sudden shattering of glass and is designed to respond to the special characteristics of such signals the circuit will provide a very high degree of protection against deliberate attempts to force entry.

The circuit 53, 54, 56 which is responsive to the comparatively high-level filtered signals indicative of shattering may be modified. Amplifier 53 could be omitted and the detector 54 connected to the output of the amplifier 33 with appropriate adjustment of signal level to the detector 54. In fact any form of threshold circuit could be used to monitor for high level signals provided it is capable of delivering sufficient charge to the capacitor to reliably cause the voltage developed on the capacitor to exceed the level at which circuit 42 operates.

In a still further modification of the circuit of FIG. 1 it is contemplated that the envelope detector 34 may be omitted so that the signals from amplifier 33 are fed directly to Schmitt trigger 36 which is constructed to act at high speed so as to respond to individual cycles of the filtered signal and deliver constant pulse in response to each cycle which exceeds the threshold level. The Schmitt trigger can be thus considered as combining the functions of detector and pulse generator in these circumstances.

It has been described how a number of sensors can be effectively paralleled into a single processing unit 30. Equally a number of processing units 30 could have their relay outputs taken through an OR-gate (not shown) to a common alarm.

Where the connecting medium 20 between individual transducers and the signal processing unit 30 includes one or more connecting cables, attempts to tamper with the signals from the piezo-electric sensors by say cutting the cables can be readily detected by including with the unit 30 a tamper detecting unit 50 connected to the cables and which applies some distinctive signal to them distinguishable from other signals present in the system. The interruption or disturbance of this distinctive signal by an attempt to cut or otherwise disable the cable will itself set off an alarm indicaton. To this end the tamper unit 50 can apply a direct potential of preselected value across each pair of lines constituting each cable so as to cause a current flow therein interference with which can be detected by monitoring for a change in potential resulting from the interference with current flow in a cable. To this end each sensor device 10 is provided with a known resistive termination to allow current flow therethrough. A variation from the preselected potential condition at any cable activates a separate tamper alarm circuit 51 which as illustrated causes activation of the main alarm relay 44 although the tamper alarm signal may be used independently if required.

In FIG. 2, there is illustrated a fan-in unit 60 remote from signal processing unit 30 and combining a plurality of sensor inputs 61 into a single cable 62 through an amplifier. A tamper unit 63 acting as an AND-gate provides and monitors a selected potential on each sensor input 61 and applies this same potential to cable 62 only if the selected potential is present on all inputs 61. The potential on cable 62 and on any other like cable can then be monitored in signal processing unit 30 by a tamper detection unit therein.

In summary therefore the described system possesses the following features. The piezo-electric transducers are directly coupled to the glass which enables them to respond readily to the high frequency content of ultrasonic waves which propagate in the bulk of the glass when it is broken or scratched. It is known the ultrasonic waves are increasingly attenuated in air with increasing frequency so that a direct coupling to the glass enables the comparatively small high frequency content to be detected. The apparatus is designed to respond only to this characteristic high frequency content distinctive of breaking, cutting or scoring, or chipping of glass. Cutting but not chipping has a further characteristic that the high frequency content is normally present in bursts occurring as long as the cutting continues. Advantage of this is taken to discriminate against chipping by ensuring that a number of bursts are detected before an alarm is given. This avoids a single high frequency pulse due to any sort of cause, such as tapping of the glass, setting off the alarm. Since the transducer devices are directly coupled to the glass they respond to any attempt to cut or score the glass whichever side of the glass is attacked. The sensors themselves are small, cheap and relatively unobtrusive. The sensors are relatively immune to ultrasonic vibrations generated elsewhere.

It has already been indicated that the connecting medium 20 could comprise a radio link. It is envisaged that each epoxy encapsulated transducer disc 11 could also have in the same encapsulation package a small radio transmitter modulated by the output of the transducer element 11. Assuming a suitable receiver was placed within close range of the transducer devices only very low power would be needed and a simple small transmitter could be readily included within the same package.

Figure 3:
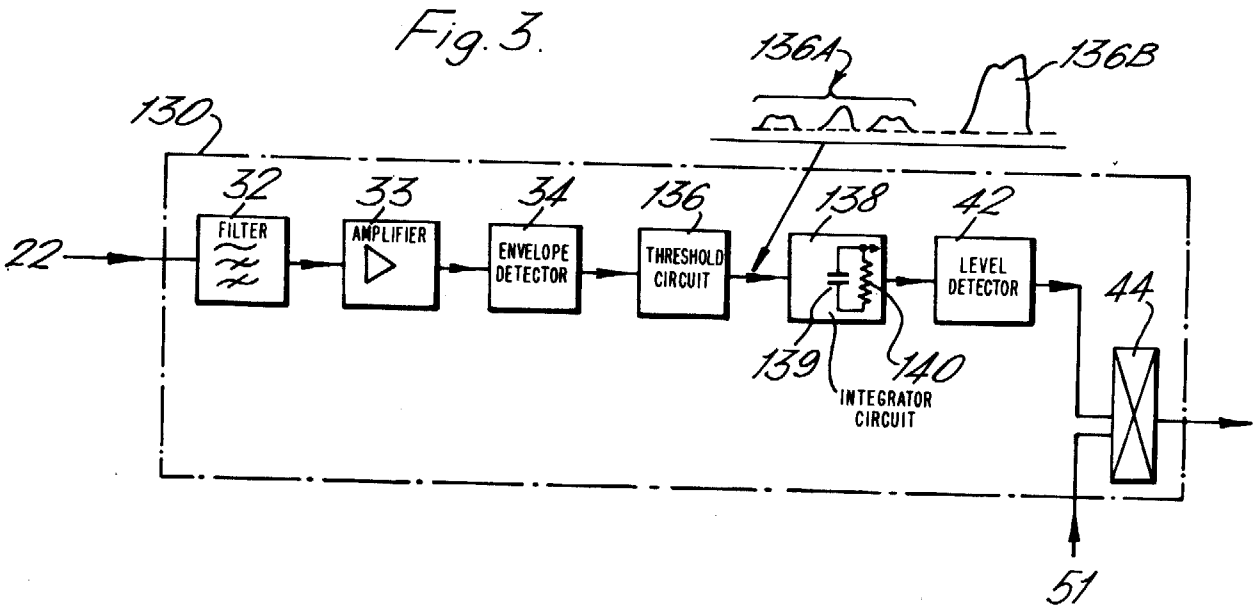
FIG. 3 shows a modified version of the system.

In the apparatus described with reference to FIG. 1 and the modifications of it, the signal processing was divided into two channels, one for the expected low level signals indicative of cutting or scoring of glass, that is elements 33, 34 and 36; and the other for the much large signals caused by shattering, that is elements 53, 54 and 56. FIG. 3 illustrates a modified version of the signal processing unit 30 which may be used in the system of FIG. 1 and which has the economic advantage of requiring only one signal processing channel.

In FIG. 3 the signal processing unit designated 130 comprises a filter 32, amplifier 33 and envelope detector 34 as in unit 30, the signal levels being chosen such that the detector 34 delivers detected signals which may contain both the low level bursts representative of cutting of the glass and the high amplitude signals due to shattering. The detected signals pass through a threshold circuit 136 which in this case is constituted by a low level amplitude gate which passes all signals without substantially modifying their amplitude provided they exceed some relatively low threshold level. This is to exclude noise as already described in relation to FIG. 1. The amplitude-gated signals then pass to an integrator circuit 138 including a capacitor 139 and discharge resistor 140. The voltage level on the capacitor 139 is monitored by a level-sensitive circuit 42 as before to operate relay 44 when the level exceeds a preselected voltage.

The input to the integrator 138 may thus contain low level pulse bursts 136A due to cutting the glass and/or large amplitude pulses 136B due to shattering of the glass. The integrator charges in proportion to the energy in the pulses, that is the area under the curves 136A and 136B, so that a single large pulse 136B will have the effect of many small pulses 136A. By adjustment of the electrical dimensions of the circuits reliable detection of both scoring or cutting and shattering of sheet glass can be achieved in this simpler single channel arrangement.

In this single channel unit it may be desirable to reduce the discharge time constant of the capacitor 139, though the value is not critical. Thus values below 100 milliseconds are usable. A time constant of 20 milliseconds has been successfully employed and may possibly range down to 10 milliseconds.

What is claimed is:

1. Apparatus for detecting damage to sheet glass including:

a rigid housing having a surface for attachment to a sheet of glass;

a transducer element of a ceramic piezoelectric material rigidly supported in said housing, said element having electrical contacts made thereto to provide signals corresponding to vibrations transmitted to said element;

and an electrical circuit connected to said transducer element contacts, said circuit including filtering means preventing response to any audio frequency signals generated by said transducer element while allowing response to signals in an ultrasonic frequency range about 100 kHz, and output means responsive to signals in said ultrasonic frequency range and constructed to provide a predetermined requirement of signal amplitude and/or duration in said ultrasonic frequency range to provide an output signal in response to ultrasonic signals meeting said requirement.

2. Apparatus as claim in claim 1 in which said housing comprises a rigid material in which said transducer element is embedded.

3. Apparatus as claimed in claim 2 in which said rigid material is a mass of epoxy resin.

4. Apparatus as claimed in claim 1 in which said transducer element comprises a disc of said piezoelectric material, the plane of the disc being parallel to that of said attachment surface.

5. Apparatus for detecting damage to sheet glass comprising:

a transducer element of an amorphous piezoelectric material in a plate-like shape;

a rigid housing in which said transducer element is supported, said housing comprising means rigidly supporting said transducer element about the periphery of said plate-like shape, and said housing having a surface portion attachable to a sheet of glass to allow transmission of virbrations from the glass to said transducer element;

and an electric circuit connected to said transducer element to receive signals therefrom corresponding to such vibrations, said circuit including filtering means preventing response to any audio frequency signals generated by said transducer element while allowing response to signals in an ultrasonic frequency range about 100 kHz, and output means responsive to signals in said ultrasonic frequency range and constructed to provide a predetermined requirement of signal amplitude and/or duration in said ultrasonic frequency range to provide an output signal in response to ultrasonic signals meeting said requirement.

6. Apparatus as claimed in claim 5 in which said transducer element is in the form of a disc and is supported with the plane of the disc parallel to said attachment surface portion.

* * * * *